United States Patent [19]

Keller et al.

[11] 4,000,407

[45] Dec. 28, 1976

[54] COMBINED INFRARED FILTER AND LIGHT FOCUSING APPARATUS FOR A MERCURY VAPOR LAMP

[75] Inventors: Charles H. Keller, Sunnyvale; Patrick O. Wilson, Cupertino, both of Calif.

[73] Assignee: Illumination Industries Inc., Sunnyvale, Calif.

[22] Filed: Apr. 7, 1975

[21] Appl. No.: 565,806

[52] U.S. Cl. ..... 240/47; 240/9 A; 240/103 R

[51] Int. Cl.[2] ..... F21V 29/00

[58] Field of Search ..... 240/47, 103 R, 9 A

[56] References Cited

UNITED STATES PATENTS

| | | | |
|---|---|---|---|
| 1,435,193 | 11/1922 | Anderson | 240/47 X |
| 1,457,646 | 6/1923 | Wilson | 240/47 |
| 1,630,056 | 5/1927 | Buttolph | 240/47 |
| 1,680,583 | 8/1928 | Anderson | 240/47 X |
| 1,895,887 | 1/1933 | Lorenz | 240/47 |
| 2,380,682 | 7/1945 | Boerstler | 240/47 X |
| 3,766,377 | 10/1973 | Junginger | 240/47 X |

*Primary Examiner*—Ulysses Weldon
*Attorney, Agent, or Firm*—Limbach, Limbach & Sutton

[57] ABSTRACT

One or more hollow, light transparent elements filled with a liquid coolant-filter are interposed between a high intensity mercury vapor lamp and an object to be illuminated in order to simultaneously filter out infrared radiation and focus the illumination from the lamp. In two embodiments the light transparent elements include two hollow quartz tubes which, in the first embodiment, are parallel to each other and to the lamp and in the second embodiment surround the lamp but are separated from it by an annular air space. In a third embodiment the light transparent elements include a hollow, rectangular, quartz box, for containing the liquid coolant-filter, and a Fresnel lens affixed to the underside of the box for focusing the light.

17 Claims, 7 Drawing Figures

COMBINED INFRARED FILTER AND LIGHT FOCUSING APPARATUS FOR A MERCURY VAPOR LAMP

BACKGROUND OF THE INVENTION

This invention relates to a light cooling and filtering device for a mercury-arc type lamp and more particularly to a light cooling and filtering device for a line source of light.

A line, light source of high intensity is sometimes required in photodevelopment applications, such as curing of inks, paints and coatings where the light is used to cure photosensitive material on a web or sheet. In such processes, it is desirable that the lamp have a long life span, that it be of high intensity, but that it also be of relatively low temperature so as not to burn the material which is being "developed."

Such lamps must operate in a temperature range which is above the boiling point of mercury, 450° C., and below the devitrification temperature of the quartz envelope of the lamp. The cooling must be evenly distributed along the length of the lamp. Prior art cooling devices typically use moving air; however, this has the disadvantage that the moving air may disturb the object which is being cured by the lamp. Also, such cooling by air has no effect in blocking infrared radiation from the lamp which tends to heat the web of material, which is being cured by means of the lamp, and the cooling devices.

SUMMARY OF THE INVENTION

The above and other disadvantages are overcome by the present invention of a high intensity light source for illuminating an object comprising a high intensity lamp which faces the object, a reflector partially surrounding the lamp on its side opposite to the object, and hollow, transparent means adjacent to the lamp and interposed between the lamp and the object, through which a liquid coolant-filter is passed by circulating means for simultaneously filtering infrared radiation and focusing the light from the lamp onto the object to be illuminated.

In one preferred embodiment the hollow, transparent means comprise a plurality of transparent, elongated, hollow tubes which are aligned parallel to the length of the lamp. The cylindrical wall surfaces of the tubes act as lenses and the contained liquid coolant simultaneously filters out infrared radiation and cooperates with the tube walls to refract and focus the light passing therethrough.

In another embodiment an outer, hollow, transparent tube surrounds a similar inner tube which, in turn, surrounds the lamp. The inner and outer tubes have internal diameters greater than the external diameter of the lamp. The tubes are thus spaced apart from the lamp's exterior surface so as to define an air containing space between the exterior surface of the lamp and the interior surface of the inner tube. The internal diameter of the outer tube is greater than the external diameter of the inner tube so as to define an elongated annular space therebetween. The liquid coolant-filter circulating means circulates the liquid coolant-filter over the length of the elongated annular space to provide a focusing element for the lamp while simultaneously filtering infrared radiation.

In the preferred embodiments the reflector is hollow and water circulates through it. The reflector may take a number of cross-sectional shapes, such as a parabola, cardioid or ellipse.

It is therefore an object of the present invention to provide means for simultaneously focusing the light of a mercury vapor lamp while also filtering out infrared radiation.

It is another object of the invention to provide cooling means for a mercury vapor lamp which evenly cools the lamp at a temperature above the boiling point of mercury and below the devitrification point of the transparent material of which the lamp is constituted.

The foregoing and other objectives, features and advantages of the invention will be more readily understood upon consideration of the following detailed description of certain preferred embodiments of the invention, taken in conjunction with the accompanying drawings.

DETAILED DESCRIPTION OF CERTAIN PREFERRED EMBODIMENTS

Figure 2:
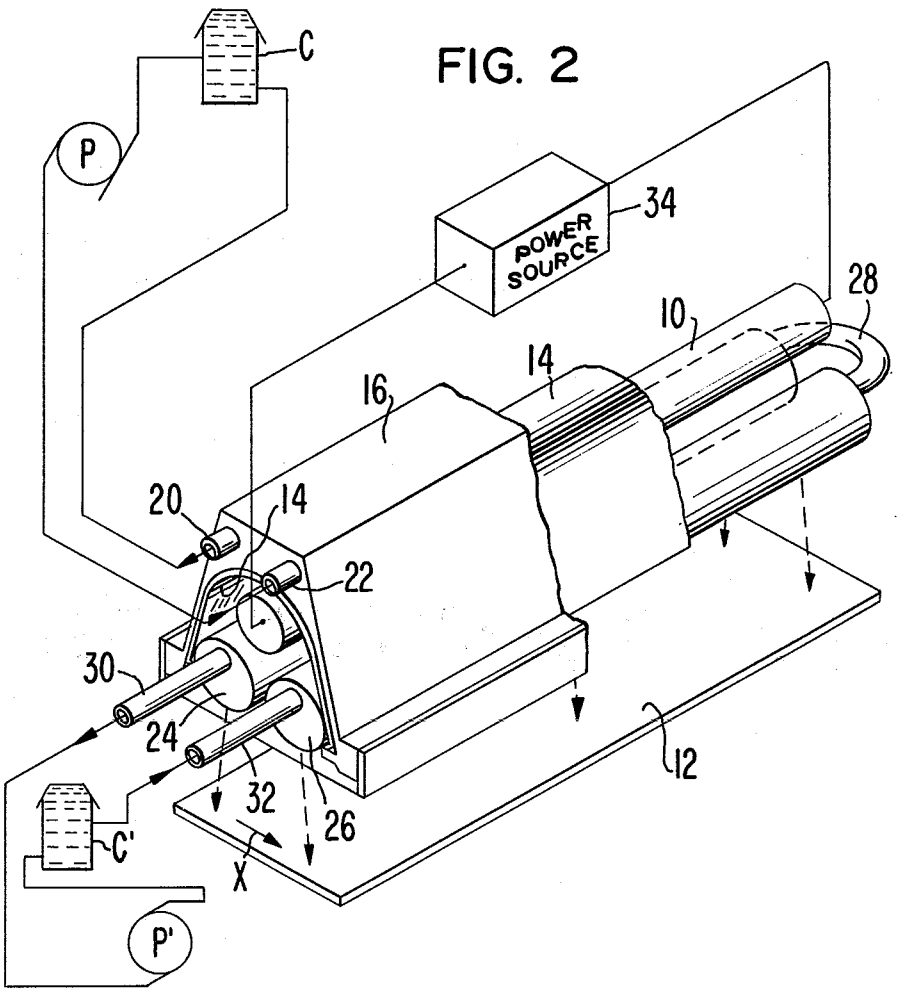
FIG. 2 is a perspective, diagrammatic view, with portions broken away and in section, of the embodiment depicted in FIG. 1.
Figure 1:
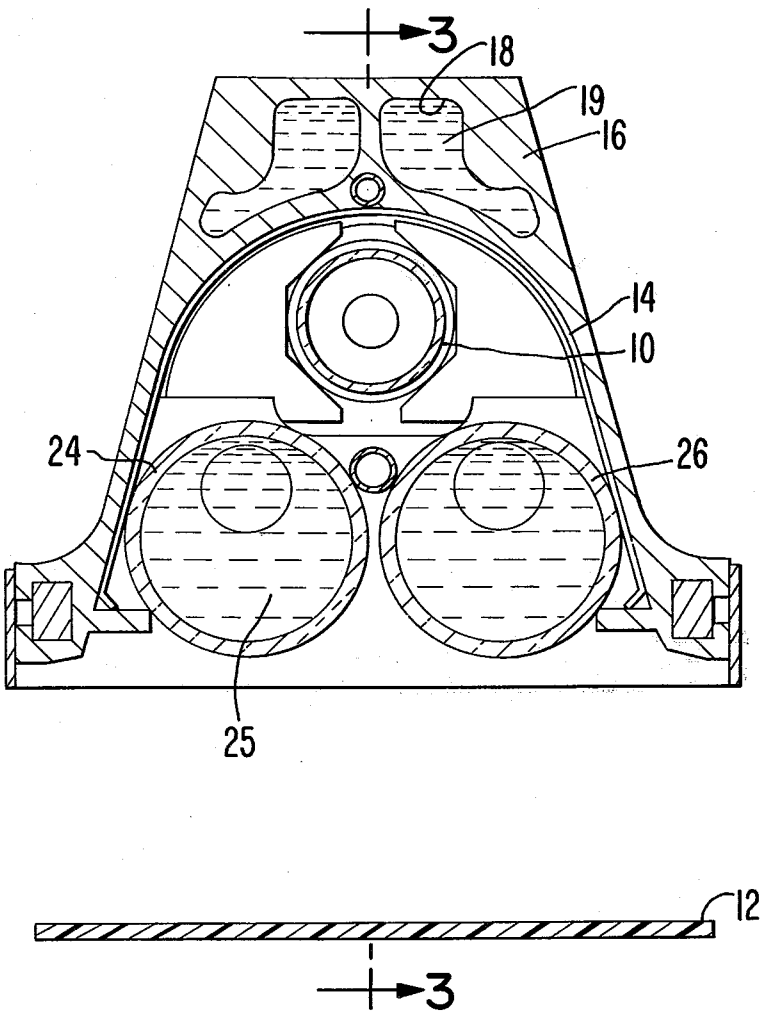
FIG. 1 is a vertical end view, in section, of a first preferred embodiment of the invention.
Figure 3:
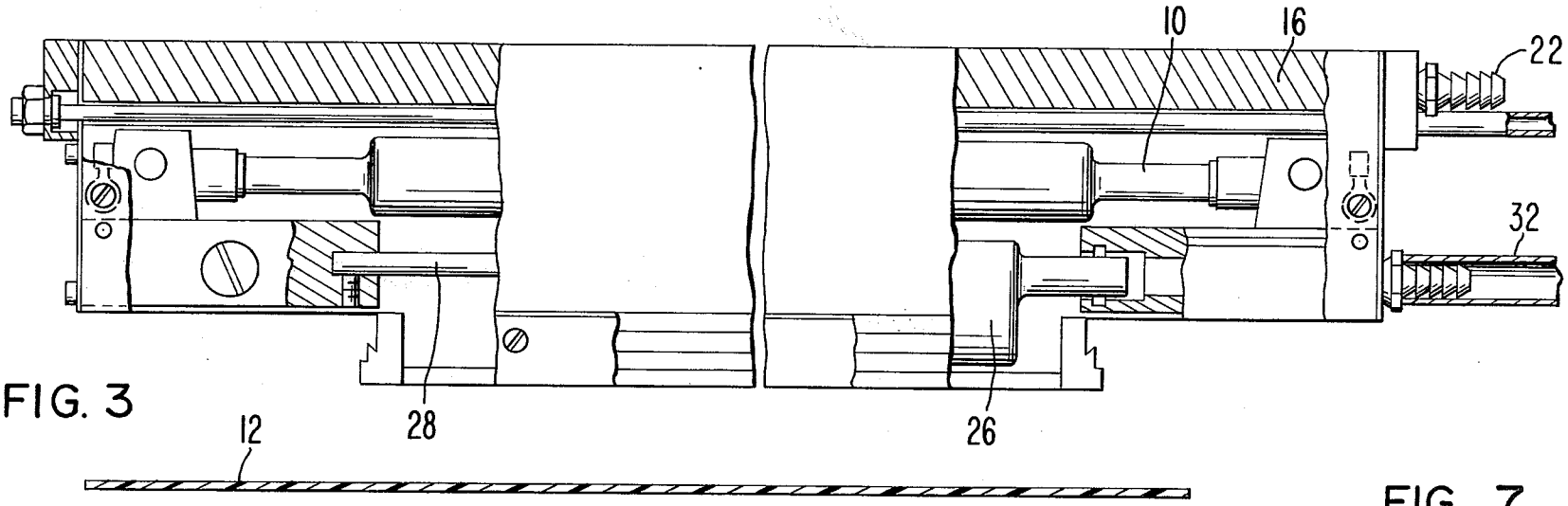
FIG. 3 is a cross-sectional view taken generally along the line 3–3 in FIG. 1.

Referring now more particularly to FIGS. 1, 2 and 3, an elongated lamp, such as a mercury vapor lamp 10, is placed over an object to be illuminated, such as a web of graphic material 12. The mercury vapor lamp 10 is encompassed on its side which is opposite to the web 12 by a reflector 14 which has an arc shape in cross-section. The reflector is elongated and stretches the entire length of the lamp 10. The reflector 14 includes a case 16 which has longitudinally extending hollow spaces 18 which are filled with a liquid coolant 19, such as water. The ends of the reflector case 16 are closed off and are provided with a coolant inlet pipe 20 and a coolant outlet pipe 22 which are connected to suitable pumping means P through a cooling apparatus, such as a cooling tower C.

A pair of transparent tubes 24 and 26 are placed within the curvature of the reflector 14 but between the lamp 10 and the object 12. The tubes 24 and 26 are parallel to each other and to the length of the lamp 10. The tubes 24 and 26 are preferably made of a material which is both transparent and has a relatively high devitrification temperature. One such suitable material is quartz. The tubes 24 and 26 are hollow and are preferably connected together by a pipe or manifold 28 at one end and are connected at their other ends by pipes 30 and 32 to a pump P′ and a cooling apparatus, such as a cooling tower C′ which circulate a liquid coolant-filter 26 through the tubes 24 and 26. A suitable power source 34 is connected across the ends of the lamp 10 to light it.

Figure 4:
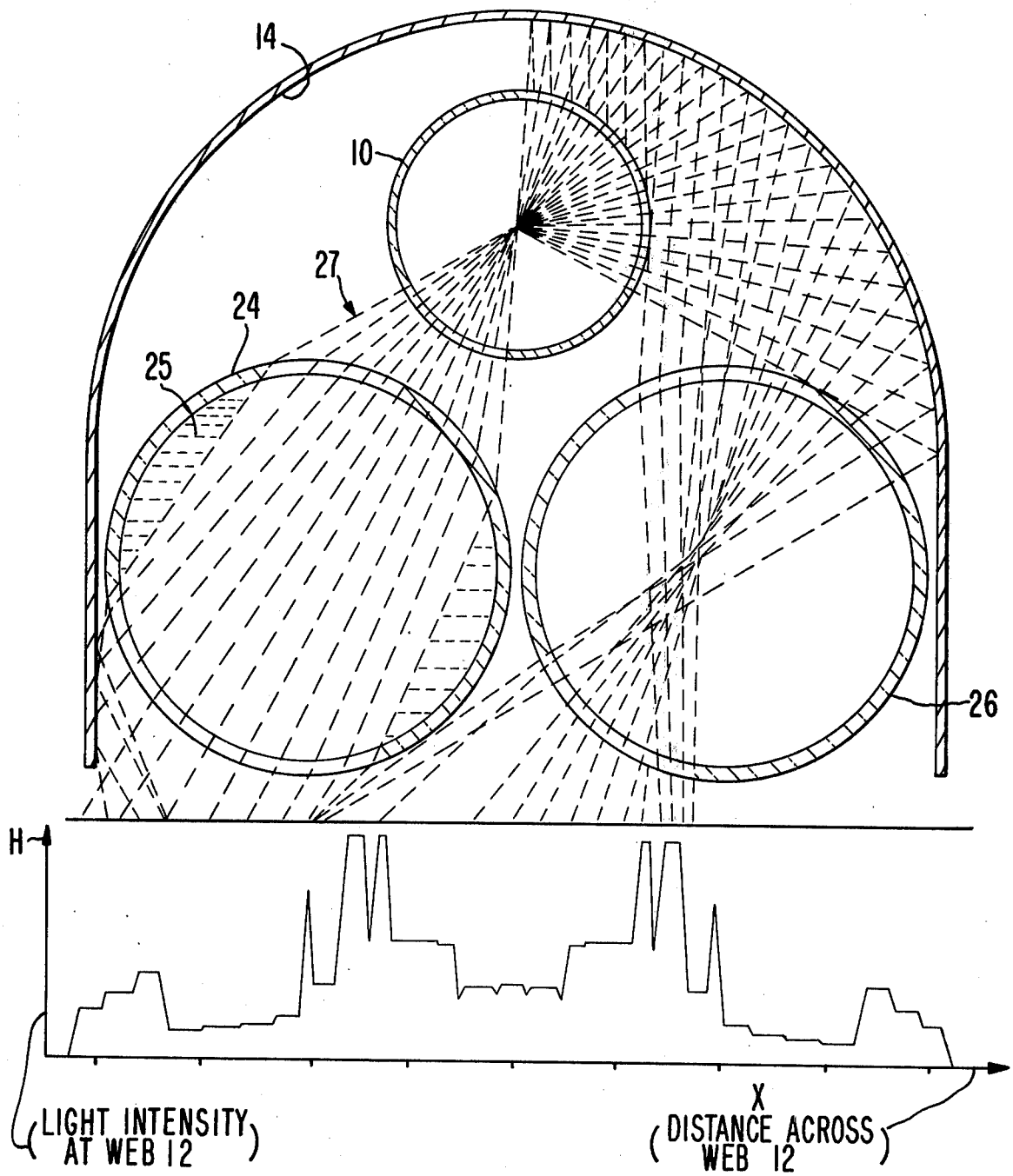
FIG. 4 is a diagrammatical representation of the illumination distribution function at the object to be illuminated by the lamp according to the first embodiment of the invention.

Light emitted by the lamp 10 and reflected by the reflector 14 is refracted and focused in passing through the coolant filled tubes 24 and 26 as indicated by the dashed lines 27 in FIG. 4. For purposes of clarity in the illustration, in the right half of FIG. 4 only the path taken by the reflected light and its contribution to the illumination intensity at the web 12 are illustrated whereas the left half of the Figure only illustrates the path and contribution of the direct light from the lamp.

The coolant 25 is chosen for its ability to filter out infrared light while simultaneously transmitting the desirable ultraviolet light, which is necessary for the development of the graphic material on the web 12. Two examples of suitable coolants are water or, in some cases, 5% aqueous copper sulfate. The use of concentrations of copper sulfate even eliminates some portion of the visible light, leaving only the ultraviolet. Other suitable coolants will be apparent to those skilled in the art.

By filtering out the infrared light the problems of overheating or burning the web 12, and any supporting structure beneath it, are avoided. Since the tubes 24 and 26 and the reflector structure 14 and 16 are spaced from the lamp 10 it is not cooled below its optimum operating temperature. Thus the light emitted by the lamp 10 is both cooled and focused without simultaneously reducing the temperature of the lamp below its optimum operating temperature.

Figure 5:
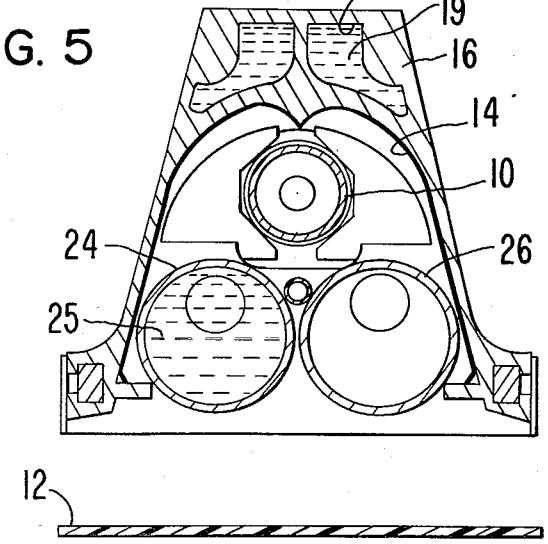
FIG. 5 is a vertical end view, in section, of a second embodiment of the invention.

Referring now more particularly to FIG. 5, a modification of the embodiment depicted in FIGS. 1–3 is illustrated in which the reflector 14 is cardioid shaped in cross-section so as to provide a somewhat more even distribution of the reflected illumination.

Figure 6:
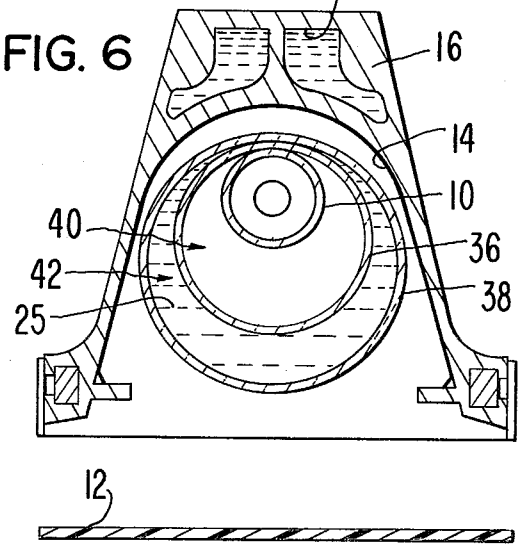
FIG. 6 is a vertical end view, in section, of a third embodiment of the invention.

Referring now more particularly to FIG. 6, still another embodiment of the invention is depicted in which the lamp 10 is positioned within an inner, transparent tube 36 which, in turn, is positioned within an outer tube 38. The internal diameter of the tube 36 is greater than the external diameter of the lamp 10 so that an annular, air filled space 40 is created between the interior surface of the tube 36 and the exterior surface of the lamp 10.

The interior diameter of the tube 38 is greater than the exterior diameter of the tube 36 so that an annular space 42 is created therebetween. This annular space 42 contains the circulating coolant-filter liquid supplied from the pump P'. The tubes 36 and 38 are made of transparent material having a relatively high melting point, such as quartz.

As in the embodiments described above, the coolant-filter liquid 25 absorbs the infrared light emitted by the lamp 10 while transmitting the ultraviolet light. The tubes 38 and 36 are mounted noncoaxially with each other and with the lamp so that the liquid filled annular space 42 also effectively acts as an elongated, converging meniscus type lens for the light emitted by the lamp 10 in addition to being an infrared filter. In other, less advantageous embodiments, the tubes 36, 38 and the lamp 10 may be coaxial; however, less desirable light focusing is obtained in such embodiments.

In all the embodiments, the tubes 24 and 26 in the embodiments of FIGS. 1–5 and the tubes 36 and 38 in the embodiment of FIG. 6 provide not only a light focusing means for the lamp 10 but also serve to filter out infrared radiation which would otherwise heat up the object 12 to an undesirable temperature. By focusing the light energy more efficient use of the lamp 10 is made than if the illumination were not focused. Because the cooling of the lamp 10 is substantially uniform along its length the lamp also has a fairly uniform level of illumination distributed along its length as compared to prior art lamps of this type.

Figure 7:
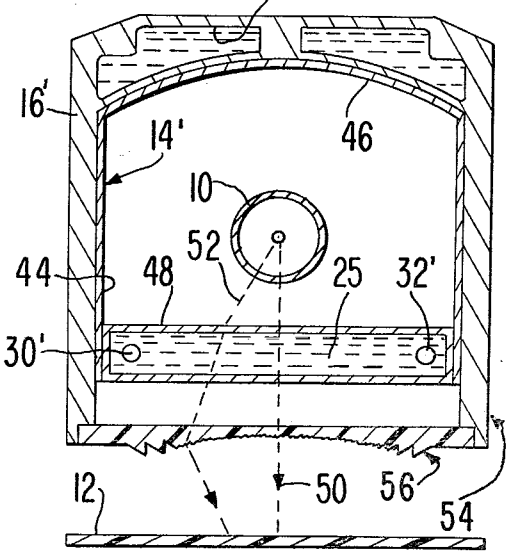
FIG. 7 is a diagrammatic vertical end view, in section, of a fourth embodiment of the invention.

Referring now more particularly to FIG. 7, still another embodiment of the invention is depicted in which similiar components to the emobodiments described above in reference to FIGS. 1 and 6 have been given the same reference numerals or the same reference numerals primed. It will be understood that elements with such corresponding reference numerals operate substantially the same way as the elements described above. The lamp 10 is mounted in an elongated housing 16' which has a pair of elongated cavities 18' through which liquid coolant is circulated by means of the pump P in the manner described above in reference to FIGS. 1 and 2. The interior of the housing 16' is lined with a reflector 14' having substantially flat, parallel side walls 44 and an upper wall 46 which is elliptical in cross-section and which bridges between the top edges of the walls 44, as viewed in FIG. 7.

Beneath the lamp 10, as viewed in FIG. 7, is a substantially flat chamber 48 made of a light transparent material such as quartz and which is filled with the liquid coolant-filter 25. Pipes 30' and 32' connect the interior of the chamber 48 with the pump P' and the cooling means C' to circulate the liquid coolantfilter 25 in the manner described above in reference to the other embodiments. A hypothetical light ray 52 from the lamp 10 is slightly refracted in passing through the chamber 48 and a substantial amount of the infrared radiation in the light ray is absorbed by the liquid coolant filter 25. The amount of infrared radiation absorbed, of course, depends upon the thickness of the chamber 48 and the degree of absorption of the liquid coolant filter 25. The side walls of the chamber 48 are mounted against the reflector walls 44, which in turn are affixed to the side walls of the housing 16'. This construction minimizes loss of light since stray light rays striking the side of the chamber 48 are thus reflected.

A pair of spaced supports 54 at the opposite edges of the chamber 48 support a Fresnel lens 56 suspended beneath the chamber 48 in an orientation parallel to its flat walls and to the web 12, as viewed in FIG. 7. The Fresnel lens 56 focuses the light ray 52 towards a hypothetical vertical center line 50.

In the preferred embodiments the center of the elliptic surface 46, the longitudinal axis of the lamp 10 and the longitudinal center line of the Fresnel lens 56 are all within one hundredth of an inch of the hypothetical vertical center line 50.

Although it is not depicted in the Figures, it should be understood that the lamps and the tubes are supported at their ends by external structures which are shown in the Figures but are not described in detail, since they form no part of the invention and are apparent to those having ordinary skill in the art.

The terms and expressions which have been employed here are used as terms of description and not of limitation, and there is no intention, in the use of such terms and expessions, of excluding equivalents of the features shown and described, or portions thereof, it being recognized that various modifications are possible within the scope of the invention claimed.

What is claimed is:

1. Apparatus for filtering and focusing light directed from a high intensity light source toward an object comprising a reflector partially surrounding the light source on its side opposite to the object, means for filtering infrared radiation from the illumination and simultaneously refracting the illumination towards the object to be illuminated, the means for filtering and refracting including a liquid coolant filter, hollow, transparent means, including a plurality of transparent, elongated hollow tubes aligned parallel to the length of the light source, interposed between the light source and the object for containing the liquid coolant-filter, and means for circulating the liquid coolant filter in the hollow, transparent means.

2. Apparatus as recited in claim 1 wherein the reflector means are hollow and further including means for circulating a liquid coolant through the hollow reflector.

3. Apparatus as recited in claim 1 wherein the reflector is cardioid in cross-sectional shape.

4. Apparatus as recited in claim 1 wherein the liquid coolant-filter comprises water.

5. Apparatus as recited in claim 1 wherein the liquid coolant-filter comprises aqueous copper sulfate.

6. Apparatus as recited in claim 1 wherein the hollow, transparent means comprise a hollow, rectangularly shaped box of light transparent material for containing the liquid coolant-filter and lens means adjacent to the box and positioned between the object and the box for focusing the light passing through the box toward the object.

7. Apparatus as recited in claim 6 wherein the lens means comprise a Fresnel lens.

8. Apparatus as recited in claim 7 wherein at least a portion of the reflector means is elliptical in cross-section and is situated with the light source interposed between the object and the elliptical portion of the reflector means, the vertex of the elliptical portion, the longitudinal axis of the lamp and the center of the Fresnel lens are aligned along a hypothetical axis which is perpendicular to the object to be illuminated.

9. Apparatus for filtering and focusing light directed from a high intensity light source toward an object comprising a reflector partially surrounding the light source on its side opposite to the object, means for filtering infrared radiation from the illumination and simultaneously refracting the illumination towards the object to be illuminated, the means for filtering and refracting including a liquid coolant-filter, hollow, transparent means interposed between the light source and the object for containing the liquid coolant-filter, the hollow, transparent means including a pair of inner and outer, hollow, transparent tubes, the inner tube surrounding the light source and the outer tube surrounding the inner tube, the inner and outer tubes having internal diameters greater than the diameter of the light source and being spaced apart from the light source so as to define an air containing space therebetween, the internal diameter of the outer tube being greater than the external diameter of the inner tube so as to define an elongated annular space therebetween for containing the liquid coolant-filter, and means for circulating the liquid coolant-filter over the length of the elongated annular space.

10. Apparatus as recited in claim 9 wherein the light source is elongated and at least one of the inner and outer tubes has a separate longitudinal axis from the longitudinal axis of the light source.

11. Apparatus as recited in claim 9 wherein the reflector means are hollow and further including means for circulating a liquid coolant through the hollow reflector.

12. Apparatus as recited in claim 9 wherein the reflector is cardioid in cross-sectional shape.

13. Apparatus as recited in cliam 9 wherein the liquid coolant-filter comprises water.

14. Apparatus as recited in claim 9 wherein the liquid coolant-filter comprises aqueous copper sulfate.

15. Apparatus as recited in claim 9 wherein the hollow, transparent means comprise a hollow, rectangularly shaped box of light transparent material for containing the liquid coolant-filter and lens means adjacent to the box and positioned between the object and the box for focusing the light passing through the box toward the object.

16. Apparatus as recited in claim 15 wherein the lens means comprise a Fresnel lens.

17. Apparatus as recited in claim 16 wherein at least a portion of the reflector means is elliptical in cross-section and is situated with the light source interposed between the object and the elliptical portion of the reflector means, the vertex of the elliptical portion, the longitudinal axis of the lamp and the center of the Fresnel lens are aligned along a hypothetical axis which is perpendicular to the object to be illuminated.

* * * * *